US009229414B2

(12) United States Patent
Jung

(10) Patent No.: US 9,229,414 B2
(45) Date of Patent: Jan. 5, 2016

(54) IMAGE FORMING APPARATUS AND METHOD OF CONTROLLING MOTOR

(71) Applicant: SAMSUNG Electronics Co., Ltd., Suwon-si, Gyeonggi-do (KR)

(72) Inventor: Tae-il Jung, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/301,386

(22) Filed: Jun. 11, 2014

(65) Prior Publication Data

US 2015/0177672 A1 Jun. 25, 2015

(30) Foreign Application Priority Data

Dec. 23, 2013 (KR) ..... 10-2013-0161067

(51) Int. Cl.

| | |
|---|---|
| ***B41J 2/385*** | (2006.01) |
| ***G03G 15/00*** | (2006.01) |
| ***G03G 15/01*** | (2006.01) |
| ***G03G 21/14*** | (2006.01) |

(52) U.S. Cl.

CPC ..... *G03G 15/757* (2013.01); *G03G 15/0178* (2013.01); *G03G 15/505* (2013.01); *G03G 15/5008* (2013.01); *G03G 21/14* (2013.01); *G03G 2215/0158* (2013.01)

(58) Field of Classification Search

USPC ..... 347/229, 232–235, 248–250, 116; 399/167, 299, 301, 303, 306, 66

See application file for complete search history.

(56) References Cited

U.S. PATENT DOCUMENTS

| | | | | |
|---|---|---|---|---|
| 6,278,857 | B1 | 8/2001 | Monji et al. | |
| 6,876,821 | B2 * | 4/2005 | Ishii et al. | 399/49 |
| 2006/0257158 | A1 | 11/2006 | Calamita | |
| 2007/0110477 | A1 * | 5/2007 | Handa et al. | 399/167 |
| 2007/0242986 | A1 | 10/2007 | Matsuyama et al. | |
| 2009/0052922 | A1 * | 2/2009 | Aoyagi | 399/66 |
| 2009/0317109 | A1 * | 12/2009 | Ehara et al. | 399/66 |
| 2010/0183322 | A1 | 7/2010 | Funamoto et al. | |
| 2010/0266298 | A1 | 10/2010 | Takahashi et al. | |
| 2012/0008986 | A1 | 1/2012 | Kaji | |
| 2012/0045249 | A1 | 2/2012 | Koizumi | |

FOREIGN PATENT DOCUMENTS

| | | |
|---|---|---|
| EP | 2 317 395 A2 | 4/2011 |
| JP | 2001-22147 | 1/2001 |
| JP | 2010-191182 | 9/2010 |
| JP | 2012-18247 | 1/2012 |

(Continued)

OTHER PUBLICATIONS

International Search Report and Written Opinion mailed Oct. 16, 2014 in related International Application No. PCT/KR2014/005655.

(Continued)

*Primary Examiner* — Hai C Pham

(74) *Attorney, Agent, or Firm* — Staas & Halsey LLP

(57) ABSTRACT

An image forming apparatus includes an image forming unit configured to perform a printing operation by using a plurality of photosensitive media, a plurality of motors configured to drive the plurality of photosensitive media, and a motor controller configured to control a phase and a velocity of the other motor based on a periodic velocity of one motor from among the plurality of motors.

19 Claims, 19 Drawing Sheets

(56) References Cited

FOREIGN PATENT DOCUMENTS

| | | |
|---|---|---|
| JP | 2012-42816 | 3/2012 |
| JP | 2012-242561 | 12/2012 |

OTHER PUBLICATIONS

Extended European Search Report dated May 19, 2015 in the corresponding European Patent Application No. 14179392.7.

* cited by examiner

IMAGE FORMING APPARATUS AND METHOD OF CONTROLLING MOTOR

CROSS-REFERENCE TO RELATED APPLICATIONS

This application claims priority under 35 U.S.C. §119 from Korean Patent Application No. 10-2013-0161067, filed on Dec. 23, 2013 in the Korean Intellectual Property Office, the disclosure of which is incorporated herein by reference in its entirety.

BACKGROUND OF THE INVENTION

1. Field of the Invention

The present general inventive concept generally relates to an image forming apparatus and a method of controlling a motor, and more particularly, to an image forming apparatus to control a velocity variation between photosensitive media and to minimize a color dislocation by controlling a phase and a velocity of the other motors based on one motor from among a plurality of motors, and a method of controlling a motor.

2. Description of the Related Art

In general, an image forming apparatus may use an electronography as a laser printer, a copy machine, a multifunctional device, and a facsimile and may include an optical scanner. The image forming apparatus forms an electrostatic latent image on a surface of a photosensitive medium by using an optical beam which is outputted from the optical scanner, transfers the electrostatic latent image on a paper, and prints out a desired image.

Meanwhile, an electronography-type printer like a color laser printer includes four photosensitive media which are provided to correspond to four colors of yellow, cyan, magenta, and black, an exposure unit which forms an electrostatic latent image of a desired image by directing a light at each of the photosensitive media, a developer which develops the electrostatic latent image with a developing agent for each color, and an image forming medium (or a transfer belt or an intermediate transfer belt) which receives images developed in the respective photosensitive media to be sequentially overlapped with each other, forms an image with a completed color, and transfers the image on a paper.

Accordingly, in order to print out a desired color image, the image is developed with each color in four photosensitive media, imprinted to be overlapped on a same image position on an image forming medium so as to be a final color image, and printed out on a paper.

Meanwhile, in order to obtain a color image which is exactly matched with a desired color by overlapping the four colors on the same image position on the image forming medium, a start point and an end point where the image is transferred from the photosensitive media to the image forming medium should be exactly consistent with each other in all cases of the four colors. That is, even though images are developed clearly in the four photosensitive media, a finally obtained color image fails to express the desired colors and image if the images are transferred in the image forming medium to be slightly dislocated.

Accordingly, in order to express a desired color image, it is important to match a point of time of starting an exposure of each of the photosensitive media by the exposure unit by considering a driving velocity of the image forming medium. As such, an operation of adjusting a point of time of starting the exposure so that a plurality of colors for forming an image are precisely overlapped with each other is referred to as a color registration.

However, a photosensitive medium has a periodic velocity variation. Such periodic velocity variation occurs in all rotator systems unless it is an ideally impeccable rotator system, which may be resulted from a shape error of a photosensitive medium (eccentricity, run-out, etc.), a characteristic of a medium related to alignment or installation, a gear shape error, a gear transmission error, a structural incompleteness of a gear train, a coupling angle transmission error, etc. The velocity variation of the photosensitive media causes a color dislocation.

In this regard, efforts for controlling a structural stability of a driving unit and a developer, a degree in applying a gear, a degree of coupling, and a tolerance have been made in order to reduce the color dislocation.

However, even though the structural incompleteness is resolved to a certain degree, there still has been a limit to obtain an impeccable constant velocity of a photosensitive medium, and thus, a method of calculating a dislocation variation for each photosensitive medium and controlling a motor velocity according to the calculated dislocation variation may be additionally used.

Therefore, such a conventional method incurs high costs since it requires an independent control for each photosensitive medium, and a problem where other source to be driven than a developing unit which is not sensitive to a velocity variation are out of control since each motor has a velocity variation.

SUMMARY OF THE INVENTION

The present general inventive concept provides an image forming apparatus which is capable of controlling a velocity variation of the photosensitive media and minimizing a color dislocation by controlling a phase and a velocity of the other motors based on one motor from among a plurality of motors, a method of controlling a motor, and a computer-readable medium containing computer-readable medium as a program to execute the method described above or hereinafter.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing an image forming apparatus including an image forming unit configured to perform a printing operation by using a plurality of photosensitive media, a plurality of motors configured to drive the plurality of photosensitive media, and a motor controller configured to control a phase and a velocity of the other motors based on a periodic velocity of one motor from among the plurality of motors.

The plurality of photosensitive media may be a K photosensitive medium, a C photosensitive medium, an M photosensitive medium, and a Y photosensitive medium. The plurality of motors may be a K motor which drives the K photosensitive medium, a C motor which drives the C photosensitive medium, an M motor which drives the M photosensitive medium, and a Y motor which drives the Y photosensitive medium. The motor controller may control a velocity of the C motor, the M motor, and the Y motor based on a velocity of the K motor.

The K motor may drive an image forming medium together with the K photosensitive medium.

Meanwhile, the motor controller may sense a periodic velocity of the plurality of motors, synchronize a velocity phase of each of the plurality of motors based on the sensed periodic velocity, and feed-forward control the other motors to have a same velocity based on one motor from among the plurality of motors whose velocity phases are synchronized.

In this case, the motor controller may sense a home position of each of the plurality of photosensitive media, and determine a stop position of each of the plurality of photosensitive media based on the sensed periodic velocity and home position.

The image forming unit may form a preset pattern on the image forming medium by using each of the plurality of photosensitive media. In addition, the motor controller may sense a periodic velocity of each of the plurality of photosensitive media by sensing the pattern formed on the image forming medium.

In this case, the motor controller may check a gap variation of each of the plurality of photosensitive media by sensing the pattern formed on the image forming medium, and calculate a velocity in a form of a sine function corresponding to the gap variation.

The motor controller may control the other motors to follow a sine function of the one motor.

The motor controller may drive the one motor at a constant velocity.

The motor controller may control a velocity of the other motors to correspond to a period of a single rotation of a photosensitive medium.

The foregoing and/or other features and utilities of the present general inventive concept may be achieved by providing a method of controlling a motor, the method including receiving a control command with respect to a plurality of photosensitive media, sensing a periodic velocity of each of a plurality of motors which drives each of the plurality of photosensitive media, driving one motor at a constant velocity from among the plurality of motors, and feed-forward controlling and driving a phase and a velocity of the other motors based on the periodic velocity of the one motor which is driven at a constant velocity.

The plurality of photosensitive media may be a K photosensitive medium, a C photosensitive medium, an M photosensitive medium, and a Y photosensitive medium. The plurality of motors may be a K motor which drives the K photosensitive medium, a C motor which drives the C photosensitive medium, an M motor which drives the M photosensitive medium, and a Y motor which drives the Y photosensitive medium. The feed-forward controlling and driving may include controlling a velocity of the C motor, the M motor, and the Y motor based on the velocity of the K motor.

The K motor may drive an image forming medium together with the K photosensitive medium.

The method may further include synchronizing a velocity phase of each of the plurality of motors based on the sensed periodic velocity. In addition, the feed-forward controlling and driving may include feed-forward controlling the other motors to have a same velocity based one motor from among the plurality of motors whose velocity phases are synchronized.

In this case, the synchronizing may include sensing a home position of each of the plurality of photosensitive media, and determining a stop position of each of the plurality of photosensitive media according to the sensed periodic velocity and the home position.

The sensing a periodic velocity may include forming a preset pattern on an image forming medium by using each of the plurality of photosensitive media, and sensing a periodic velocity of each of the plurality of photosensitive media by sensing the pattern formed on the image forming medium.

The sensing a periodic velocity may include checking a gap variation of each of the plurality of photosensitive media by sensing the pattern formed on the image forming medium, and calculating a velocity in a form of a sine function corresponding to the gap variation.

In this case, the feed-forward controlling and driving may include controlling the other motors to follow a sine function of the one motor.

Meanwhile, the feed-forward controlling and driving may include controlling a velocity of the other motors to correspond to a period of a single rotation of a photosensitive medium.

The foregoing and/or other features and utilities of the present general inventive concept may also be achieved by providing a computer readable recording medium having a program to execute a method of controlling a motor, the method including receiving a control command with respect to a plurality of photosensitive media, sensing a periodic velocity of each of a plurality of motors which drives each of the plurality of photosensitive media, driving one motor at a constant velocity from among the plurality of motors, and feed-forward controlling and driving a phase and a velocity of the other motors based on the periodic velocity of the one motor which is driven at a constant velocity.

The foregoing and/or other features and utilities of the present general inventive concept may also be achieved by providing an image forming apparatus including an image forming unit having a plurality of photosensitive media and a plurality of motors configured to drive the corresponding photosensitive media to perform a printing operation, and a motor controller configured to apply a velocity to at least one of the plurality of motors, wherein a periodic velocity of the at least one motor is applied to the other ones of the plurality of motors such that phases of the other motors follow the velocity corresponding to a phase of the one motor.

The image forming apparatus may further include an intermediate transfer belt, and the plurality of motors may include a motor to drive the intermediate transfer belt.

The at least one motor to drive the corresponding photosensitive medium and the motor to drive the intermediate transfer belt may be a same motor of the plurality of motors.

The velocity may be a constant velocity, and the periodic velocity may be not a constant velocity. The periodic velocity may have a periodic characteristic corresponding to a phase. The periodic velocity may have a period of a single rotation of at least one of the plurality of photosensitive media The motor controller may transmit the periodic velocity to the other motors of the plurality of motors.

The one motor may transmit the periodic velocity to the other ones of the plurality of motors.

All of the plurality of motors may be controlled according to either one of the velocity and the periodic velocity during the printing operation.

The motor controller may generate a first number of velocities including the velocity and the periodic velocity to drive the plurality of motors, and the first number of velocities may be less than a second number of the plurality of photosensitive media.

All of the other ones of the plurality of motors may be controlled according to the same periodic velocity.

The motor controller may control the plurality of motors with the velocity and the periodic velocity after performing a gap variation controlling operation on the plurality of photosensitive media. The periodic velocity of the one motor may be applied to the other motors according to a feed-forward control method, and the velocity may be applied to the one motor according to a control method of the motor controller other than the feed-forward control method.

BRIEF DESCRIPTION OF THE DRAWINGS

These and/or other features and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
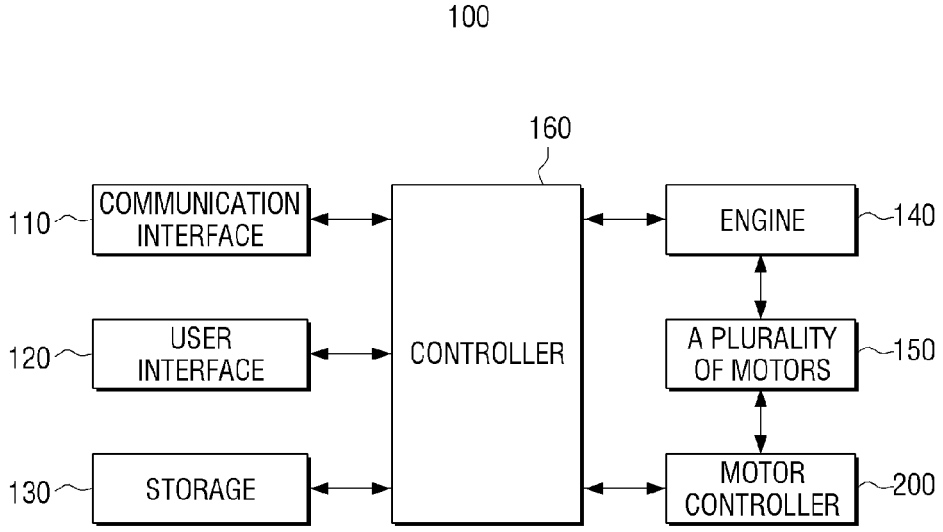
FIG. 1 is a diagram illustrating a configuration of an image forming apparatus according to an exemplary embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

The matters defined in the description, such as detailed construction and elements, are provided to assist in a comprehensive understanding of exemplary embodiments. However, exemplary embodiments can be practiced without those specifically defined matters. Also, well-known functions or constructions are not described in detail since they would obscure the application with unnecessary detail.

FIG. 1 is a diagram illustrating an image forming apparatus 100 according to an exemplary embodiment of the present general inventive concept.

Referring to FIG. 1, the image forming apparatus 100 includes a communication interface 110, a user interface 120, a storage 130, an engine 140, a plurality of motors 150, a controller 160, and a motor controller 200. The engine 140 may be referred to as a printing unit. It is possible that the engine 140 and the plurality of motors 150 may also be referred to as a printing unit. It is also possible that the engine 140, the plurality of motors 150, and the motor controller 200 may be referred to as the printing unit.

The image forming apparatus 100 may perform one or more operations, such as generating, printing, receiving, and transmitting of image data, etc, and may include a printer, a copy machine, a facsimile, and a multifunctional device having functions of a printer, a copy machine, and a facsimile in a single device. However, the present general inventive concept is not limited thereto. It is possible that the image forming apparatus may be a scanner.

The communication interface 110 is connected to a print control terminal device (not illustrated) such as a Personal Computer (PC), a laptop PC, a Personal Digital Assistant (PDA), a digital camera, etc. The communication interface 110 is formed to connect the image forming apparatus 100 to an external apparatus, for example, the print control terminal device, a smart phone, a mobile communication device, an external server, etc. The communication interface 110 of the image forming apparatus 100 may be connected to the external apparatus through a Universal Serial Bus (USB) port as well as a Local Area Network (LAN) and an internet network. In addition, the communication interface 110 may be connected to the print control terminal device through either of a wireless or wired manner.

The communication interface 110 receives print data from the external apparatus. In addition, when the image forming apparatus 100 provides a scanning function, the communication unit 110 may transmit generated scan data to the external apparatus. In addition, the communication unit 110 may receive a print control command from the external apparatus.

The user interface 120 includes a plurality of function keys to allow a user to set or select various functions supported by the image forming apparatus 100, and displays various pieces of information provided by the image forming apparatus 100. The user interface 120 may be implemented as an apparatus where an input and an output are performed simultaneously like a touch screen or panel, or may be implemented as a combination of an input device such as a mouse (or keyboard, a plurality of buttons, etc.) and an output device such as a monitor. The user may control a printing operation of the image forming apparatus 100 by using a user interface window provided through the user interface 120.

The user interface 120 may display an operating status of the image forming apparatus 100. For example, when the image forming apparatus performs a printing operation, the user interface 120 may display an image or inform the user that the image forming apparatus is in printing, and when a motor is broken, for example, the user interface 120 may display an image or inform the user that the motor is out of order.

The storage 130 stores print data. The storage 130 stores print data which is received through the communication interface 110. The print data may be received from an external apparatus. It is possible that the print data may be formed according to a scanning operation of a scanner of the image forming apparatus 100. In addition, the storage 130 may store a lookup table usable to control the motor 150. Herein, the lookup table may be a target driving velocity corresponding to a control command with respect to the motor. However, the present general inventive concept is not limited thereto. It is possible that the lookup table may be stored in the motor controller 200.

The storage 130 may store driving information on the motor 150. The storage 130 may store the driving information which is transmitted from the motor controller 200. Herein, the driving information may include information on a phase of a motor, information on a periodic velocity of the motor, information on a difference in periodic velocity between motors, etc.

Meanwhile, the storage 130 may be implemented as a storage medium within the image forming apparatus 100 or an external storage medium, for example, a removable disk having a USB memory, a web server based on a network, etc.

The engine 140 forms an image. The engine 140 may include four photosensitive media which are provided to correspond to four colors of yellow, cyan, magenta, and black, an exposure equipment which forms an electrostatic latent image of a desired image by directing a light at each of the photosensitive media, a developer which develops the electrostatic latent image with a developing agent for each color, and an image forming medium (for example, a transfer belt or an intermediate transfer belt) which receives images developed in the respective photosensitive media to be sequentially overlapped with each other, forms an image, for example, a desired color image, and transfers the image on a paper. The configurations of the engine 140 will be described below with reference to FIGS. 6 and 8.

The plurality of motors 150 may be a direct current (DC) motor which is disposed within the image forming apparatus 100, and may perform a driving operation, for example, uniform driving or accelerated driving according to an amount of an input current. Here, the plurality of motors 150 may be a motor to perform various functions of the image forming unit such as operations of driving a photosensitive medium, driving a fixing unit, or transferring one or more sheets of paper. Here, the plurality of motors may include a K motor which drives a K photosensitive medium, a C motor which drives a C photosensitive medium, an M motor which drives an M photosensitive medium, and a Y motor which drives a Y photosensitive medium. A relationship between a photosensitive medium and a motor will be described below with reference to FIGS. 6 to 9.

The motor controller 200 generates a driving signal (for example, a driving voltage) with respect to the plurality of motors 150 in response to a control command. In addition, the motor controller 200 may control a phase and velocity of the other motors based on a periodic velocity of one motor from among the plurality of motors. The configurations and operations of the motor controller 200 will be described with reference to FIG. 2.

The controller 160 controls each configuration in the image forming apparatus 100. When the print data is received from the print control terminal device, the controller 160 may control an operation of the engine 140 so that the received print data is printed out, and transmits to the motor controller 200 a control command with respect to the plurality of motors of the engine 140. For example, the controller 160 may transmit to the motor controller 200 a control command as start/stop of a rotation, acceleration/reduction of a velocity, a velocity reference value regarding the plurality of motors. Meanwhile, although it is described that the controller 160 transmits a control command with respect to the plurality of motors, the engine 140 may transmit a control command to the motor controller 200.

As described above, the image forming apparatus 100 according to the present exemplary embodiment controls a phase and velocity of the other motors based on a velocity (for example, a periodic velocity) of the one motor from among the plurality of motors, and thus, may minimize a color dislocation by preventing a velocity different between photosensitive media which are driven by the respective motors. Further, the image forming apparatus 100 according to the present exemplary embodiment does not need to perform the feed-forward control with respect to a motor, and thus, it is possible to reduce costs and design the image forming apparatus efficiently.

In addition, in the image forming apparatus 100 according to the present exemplary embodiment, a motor for which the feed-forward control is not performed may drive other sources (other motors or components) to be driven together, and thus, it is possible to omit a motor for driving other sources to be driven according to a user or design preference, which results in efficient design and cost reduction.

Meanwhile, in FIG. 1, although the plurality of motors 150 and the motor controller 200 are illustrated as the components which are independent from each other, the plurality of motors 150 may be implemented as a component within the motor controller 200. In this case, the plurality of motors 150 may be implemented as an apparatus separated from the image forming apparatus 100.

Figure 2:
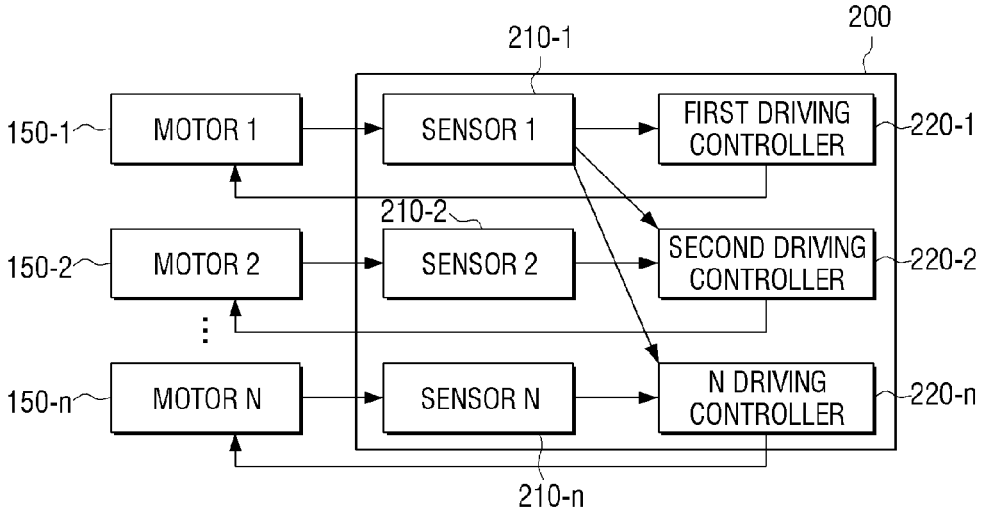
FIG. 2 is a diagram illustrating a motor controller of the image forming apparatus of FIG. 1.

FIG. 2 is a diagram illustrating the motor controller 200 of the image forming apparatus 100 of FIG. 1.

Referring to FIG. 2, the motor controller 200 according to the present exemplary embodiment includes a plurality of sensors 210 (210-1, 210-2, . . . 210-N) and a plurality of driving controllers 220 (220-1, 220-2, . . . 220-N). Here, N is a positive integer. Although FIG. 2 illustrates that the motor controller 200 does not include the motor 150, it is possible that the motor controller 150 may include a motor therein.

The sensor 210 senses a velocity of a motor. The sensor 210 may check a gap variation of a photosensitive medium by sensing a preset pattern which is formed on an image forming apparatus, and calculate a velocity in a form of a function, for example, a sine function corresponding to the gap variation. In order to sense the preset pattern which is formed on the image forming medium, the sensor 210 may include a light source which directs a light and a sensing unit which senses a strength of a reflected light which is reflected from a pattern area or a non-pattern area. An operation of calculating a gap variation and a sine function velocity of a photosensitive medium by sensing a pattern will be described below with reference to FIGS. 10 to 13. In this case, the image forming medium may be a transfer belt or an intermediate transfer belt.

Figure 7:
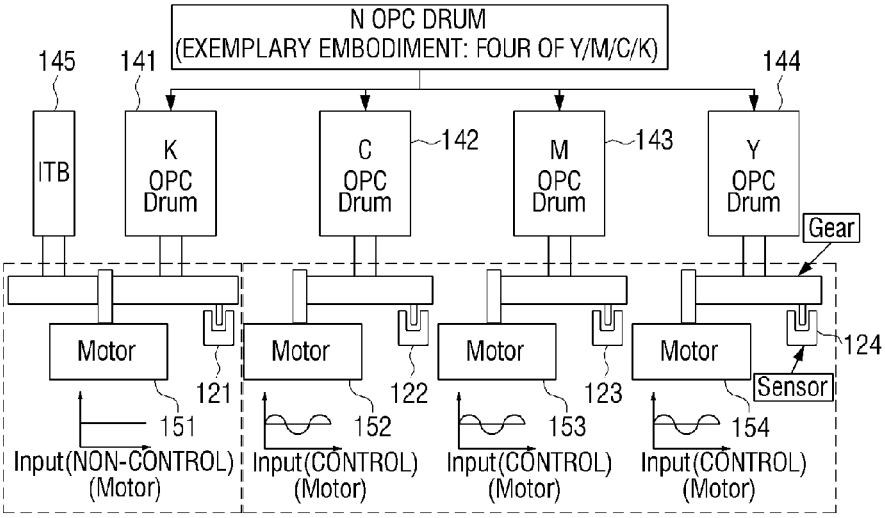
Figure 9:
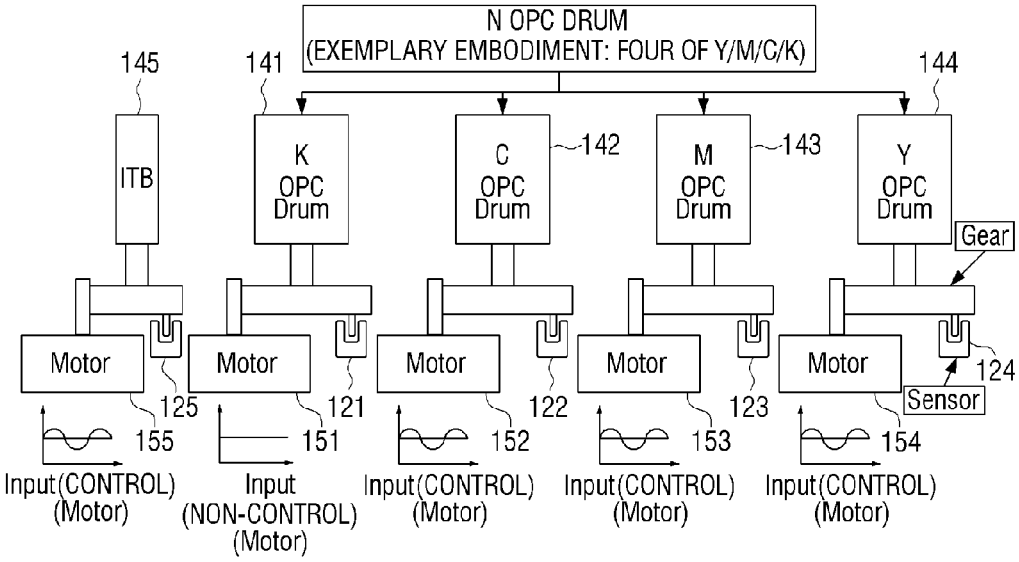

The sensor 210 may be provided to correspond to the number of motors controlled by the motor controller 200. For example, when the image forming apparatus 100 includes four motors as illustrated in FIG. 7, four sensors for sensing a velocity of each motor may be provided in the motor controller 220. When the image forming apparatus 100 includes five motors as illustrated in FIG. 9, five sensors for sensing a velocity of each motor may be provided in the motor controller 220.

The driving controller 220 receives a control command from the controller 160 and controls a driving status of the motor 150 based on the received control command. The driving controller 220 may receive a control command with respect to the motor 150 from the controller 160. In this case, the control command may include a control command corresponding to rotation start/stop, acceleration/reduction of velocity, a velocity reference value with reference to a DC motor.

Meanwhile, such a control command may be transmitted from the controller 160 through a Serial Peripheral Interface (SPI) that allows data to be exchanged by a serial communication between two apparatuses and a serial communication interface such as an $I^2C$ that is a bidirectional serial bus.

In addition, the driving controller 220 controls the corresponding motor 150 in response to the received control command. The driving controller 220 may generate a driving signal (for example, a Pulse Width Modulation (PWM) signal having a duty ratio) corresponding to the control command. Meanwhile, the driving control may vary depending upon a motor to be controlled.

The driving controller 220-1 corresponding to the K motor which drives the K photosensitive medium from among the plurality of driving controllers 220 may drive the K motor 150-1 at a constant velocity.

Meanwhile, the driving controllers 220-2 to **220-*n*** which drive the C motor, the M motor, and the Y motor other than the K motor may synchronize a phase of a corresponding motor based on a velocity of the K motor, and feed-forward control the corresponding motor to follow the velocity of the K motor. Such a control operation may be performed by a unit of a period of a single rotation of a photosensitive medium.

As described above, the motor controller 200 according to the present exemplary embodiment controls a phase and velocity of the other motors based on a periodic velocity of one motor from among the plurality of motors, and thus, may minimize a color dislocation since a different in velocity between photosensitive media which are driven by the respective motors does not occur. Further, the motor controller 200 according to the present exemplary embodiment does not need to feed-forward control at least one of the motors, and thus, it is possible to reduce the costs and design the image forming apparatus efficiently.

In addition, in the motor controller 200 according to the present exemplary embodiment, a motor for which the feed-forward control is not performed may drive other sources (components or units) to be driven together, and thus, it is possible to omit a motor for driving other sources to be driven according to a user or design preference, which results in efficient design and cost reduction.

Meanwhile, FIG. 2 illustrates that the motor controller 200 includes a number of driving controllers, the motor controller may be embodied as a single driving controller which is capable of controlling a plurality of sensors and motors, or may be embodied as a single driving controller which is capable of controlling a sensor which senses a velocity of a plurality of motors. Alternatively, the motor controller may be embodied to include a configuration which is capable of simultaneously performing an operation of sensing a velocity and an operation of controlling a motor.

Hereinafter, an operation principal of the present exemplary embodiment will be described with reference to FIGS. 3 to 5.

As mentioned above, a photosensitive medium has a periodic velocity variation. Such a velocity variation of a photosensitive medium results in a gap variation of a pattern (for example, a pattern for detecting a color dislocation) which is formed on an image forming medium (a transfer belt or an intermediate transfer belt), and the gap variation has a form of a sine curve due to the characteristic of the periodic velocity variation.

The velocity variation of a photosensitive medium and the gap variation of a pattern for detecting a color dislocation which occurs due to the velocity variation may be expressed by the following Formula 1.

$$\text{Gap variation}=A\sin(\psi t+\theta) \qquad \text{[Formula 1]}$$

In this case, A refers to an amount of variation, ψ refers to an angular velocity (2πf), f refers to a velocity variation frequency, and θ refers to a phase.

The aforementioned gap variation occurs due to a linear velocity change of a photosensitive medium, and thus, a linear velocity of the photosensitive medium may be expressed by the following Formula 2.

$$\text{Linear velocity of a photosensitive medium}=Vo+A\sin(\psi t+\theta) \qquad \text{[Formula 2]}$$

Herein, Vo refers to an average velocity of a photosensitive medium.

Accordingly, a change amount of the linear velocity of the photosensitive medium (Av) is ψt, and thus, a change amount of a position may be expressed by the following Formula 3.

$$\text{Change amount of a position } (A)=Av/\psi=Av/(2\pi f) \qquad \text{[Formula 3]}$$

Referring to Formula 3, the gap variation is directly proportional to the change amount of the velocity, and is inversely proportional to a variation frequency thereof. That is, as the amount of the velocity variation of the photosensitive medium is large and the frequency of the velocity variation is low, the gap variation increases.

Accordingly, in order to improve the gap variation, it may be required to stabilize the velocity variation of the photosensitive medium. This operation will be described in detail with reference to FIG. 3.

Figure 3:
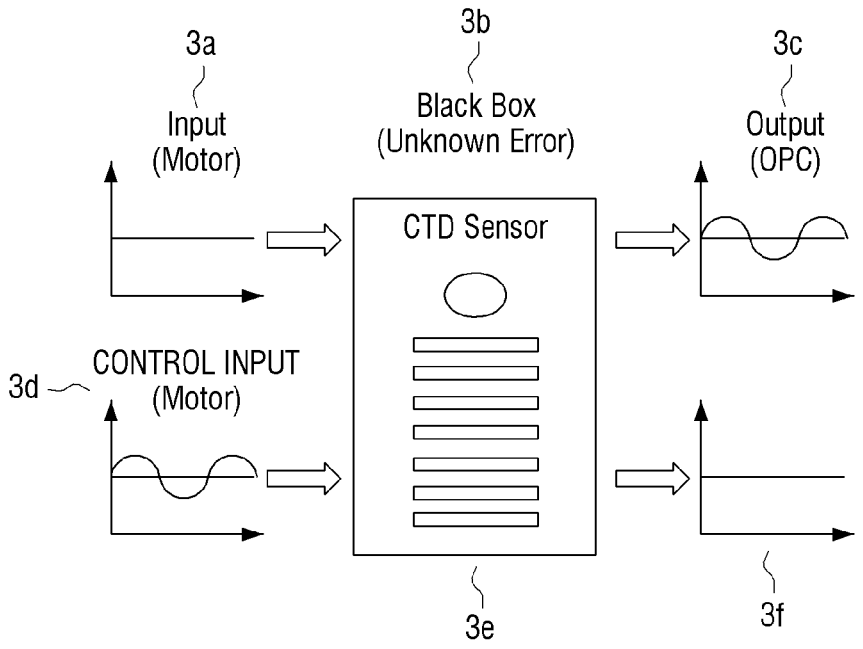
FIG. 3 is a diagram illustrating a method of controlling a position change which occurs in an image forming apparatus due to a velocity variation of a photosensitive medium according to an exemplary embodiment of the present general inventive concept.

FIG. 3 is a diagram illustrating a method of controlling a position change which occurs in an image forming apparatus due to a velocity variation of a photosensitive medium according to an exemplary embodiment of the present general inventive concept.

Referring to FIG. 3, when the motor 140 provides a certain rotational force according to an input as illustrated in a view **3*a*, an error mechanism is generated as illustrated in a view 3*b*, and an output is generated as illustrated in a view 3*c* when the rotational force passes through several transmission processes, which results in a color dislocation affecting a final result of a printed image. However, the gap variation may be improved through an appropriate variable control of a motor velocity as illustrated in views 3*d* and 3*f* by using a relation between the velocity of the motor and the gap variation of the pattern for detecting a color dislocation as illustrated in a view 3*e***.

Figure 4:
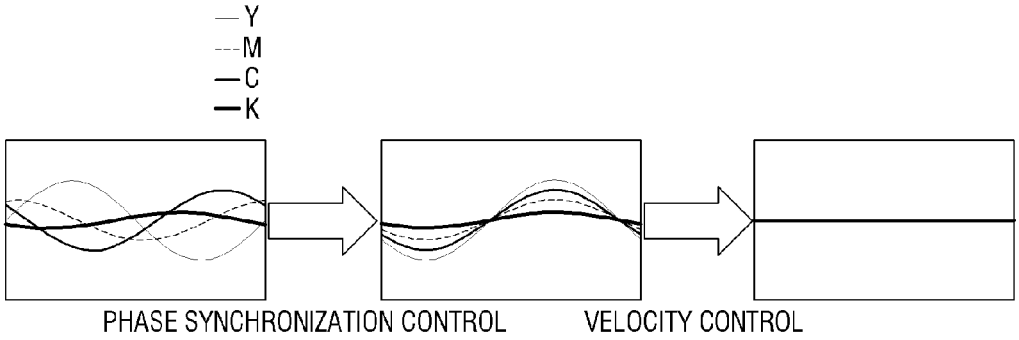
FIG. 4 is a diagram illustrating a method for controlling a velocity.

Referring to FIG. 4, when the velocity is controlled so that the linear velocity of each photosensitive medium is not changed, an error of the color registration may become reduced to zero '0' theoretically. However, in this case, the velocity control should be performed with respect to all of the plurality of motors.

Meanwhile, in a color printing operation, the color dislocation occurs due to an exposure position of each photosensitive medium, and thus, when there is no position error between photosensitive media even though the exposure position of a photosensitive medium on a sheet of paper is different, that is, when the linear velocity variations of the photosensitive media have a sine wave form whose phase and amount are the same, the error of the color registration may be reduced to '0' theoretically.

Figure 5:
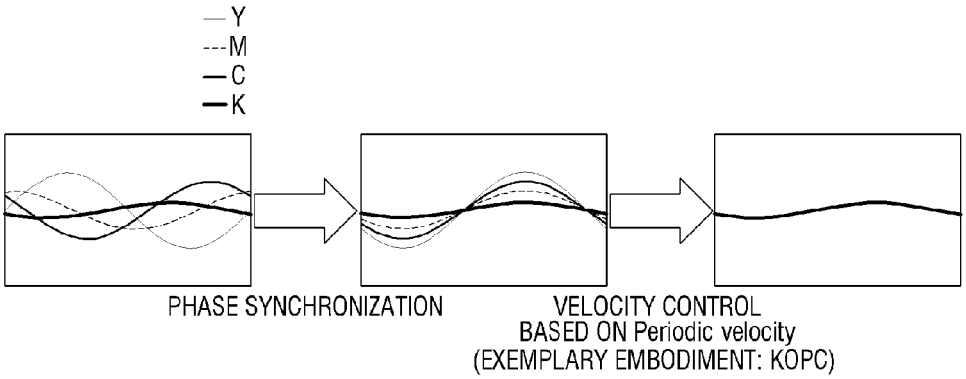
FIG. 5 is a diagram illustrating a method of controlling a velocity according to an exemplary embodiment of the present general inventive concept.

Accordingly, in the present exemplary embodiment, as illustrated in FIG. 5, phases of the colors are synchronized, and the velocities are controlled so that a phase of one color is driven at a constant velocity and the phases of the other colors follow the constant velocity.

Hereinafter, with reference to FIGS. 6 to 9, the velocity following operation is described. Meanwhile, in order to perform the velocity following operation, it is required to obtain a velocity of each motor first. An operation of generating a pattern usable to sense the linear velocity variation of a motor and an operation of preventing a gap variation will be described below with reference to FIGS. 10 to 13.

Figure 6:
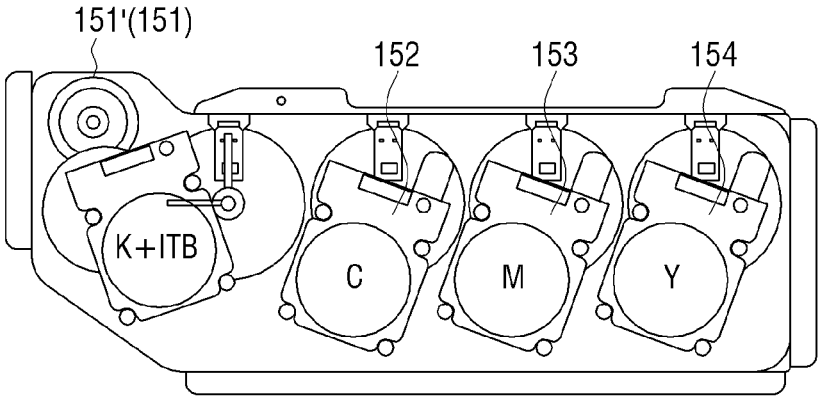
FIGS. 6 and 7 are diagrams illustrating an operation of controlling a motor of an image forming apparatus according to an exemplary embodiment of the present general inventive concept.

FIGS. 6 and 7 are diagrams illustrating an operation of controlling a motor in the image forming apparatus 100 according to an exemplary embodiment of the present general inventive concept. The image forming apparatus 100 according to the exemplary embodiment drives a photosensitive medium and an image forming medium using a single motor.

Referring to FIGS. 6 and 7, the image forming apparatus 100 according to the exemplary embodiment includes a plurality of photosensitive media 141, 142, 143, and 144, an intermediate transfer belt 145, a plurality of motors 151 (151'), 152, 153, and 154, and four home position sensors 121, 122, 123, and 124 configured to sense a home position of each of the photosensitive media 141, 142, 143, and 144.

The engine 140 forms a pattern (P) to detect a color dislocation on each of the photosensitive media 141, 142, 143, and 144 through a laser scanning unit thereof, and transfers sub-patterns of the pattern (P) formed on the photosensitive media 141, 142, 143, and 144 on the intermediate transfer belt 145. Such an operation of the engine 140 is performed by control of the motor controller 200 with respect to the plurality of motors, and the detailed description related to the operation of forming the pattern P will be described below with reference to FIGS. 10 to 13. The pattern P may include the sub-patterns corresponding to the respective photosensitive media 141, 142, 143, and 144. That is, the pattern P is divided into four sections each having the sub-patterns to correspond to each of the photosensitive media 141, 142, 143, and 144. It is possible that the pattern P may be formed to correspond to each of the photosensitive media 141, 142, 143, and 144.

The home position sensors 121, 122, 123, and 124 may include optical sensors, and sense a home position of each of the photosensitive media 141, 142, 143, and 144 by sensing a location of a projection to detect a home position, which is disposed on a side of a driving gear connected to each of the photosensitive media 141, 142, 143, and 144.

The motor controller 200 irradiates an infrared ray into the sub-patterns which are transferred on the intermediate transfer belt 145 for each of the photosensitive media 141, 142, 143, and 144, and senses a strength of a reflected light which is reflected from an area of the sub-pattern and a non-pattern area disposed between the adjacent sub-patterns.

In addition, the motor controller 200 senses the sub-patterns which are transferred on the intermediate transfer belt 145 for each of the photosensitive media 141, 142, 143, and 144, and checks a gap variation of the sub-patterns, which represents a periodic velocity variation of the photosensitive media 141, 142, 143, and 144.

In addition, the motor controller 200 may synchronize phases of the respective photosensitive media according to the checked gap variation, control the K motor 151 to drive the K photosensitive medium 141 at a constant velocity, and control the velocities of the C motor 152, the M motor 153, and the Y motor 154 so that the other photosensitive media 142, 143, and 144 follow the linear velocity of the K photosensitive medium. In this case, the intermediate transfer belt 145 is driven together by the K motor 151, and thus, the velocity of the intermediate transfer belt 145 is the same as the linear velocity of the K photosensitive medium.

In this case, the motor controller 200 may control the velocity of the motor 151 (151') so that the intermediate transfer belt 145 follows the velocity of the K photosensitive medium 141.

As described above, the image forming apparatus according to the exemplary embodiment may drive five objects to be driven by using four motors so that the linear velocities of the objects are not changed.

Figure 8:
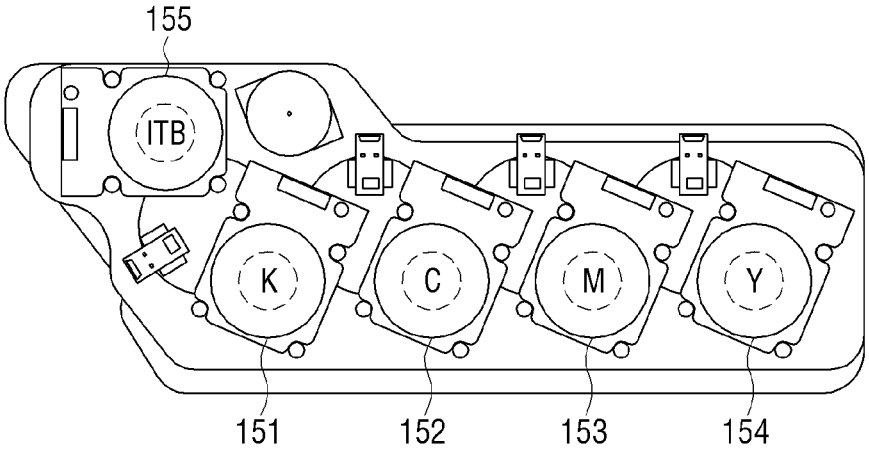
FIGS. 8 and 9 are diagrams illustrating an operation of controlling a motor of an image forming apparatus according to an exemplary embodiment of the present general inventive concept.

FIGS. 8 and 9 are diagrams illustrating an operation of controlling a motor in the image forming apparatus 100 according to an exemplary embodiment of the present general inventive concept. The image forming apparatus 100 according to the exemplary embodiment drives a photosensitive medium and an image forming medium independently.

Referring to FIGS. 8 and 9, the image forming apparatus 100 according to the exemplary embodiment includes the plurality of photosensitive media 141, 142, 143, and 144, the intermediate transfer belt 145, the plurality of motors 151, 152, 153, 154, and 155, and the five home position sensors 121, 122, 123, 124, and 125 configured to sense a home position of each of the photosensitive media 141, 142, 143, and 144 and the intermediate transfer belt 145.

The engine 140 forms the pattern P usable to detect a color dislocation on each of the photosensitive media 141, 142, 143, and 144 through the laser scanning unit thereof, and transfers the sub-patterns of the pattern P formed on the photosensitive media 141, 142, 143, and 144 on the intermediate transfer belt 145. Such an operation of the engine 140 is performed by control of the motor controller 200 with respect to the plurality of motors 151, 152, 153, 154, and 155, and the detailed description related to the operation of forming a pattern will be described below with reference to FIGS. 10 to 13.

The home position sensors 121, 122, 123, 124, and 125 may include optical sensors, and sense a home position of each of the photosensitive media 141, 142, 143, and 144 and the intermediate transfer belt 145 by sensing a location of a projection to detect a home position which is disposed on a side of a driving gear connected to each of the photosensitive media 141, 142, 143, and 144 and the intermediate transfer belt 145.

The motor controller 200 irradiates an infrared ray into the sub-patterns which are transferred on the intermediate transfer belt 145 for each of the photosensitive media 141, 142, 143, and 144 by using a Color Toner Density (CTD) sensor, and senses a strength of a reflected light which is reflected from an area of the sub-pattern and a non-pattern area disposed between the adjacent sub-patterns.

In addition, the motor controller 200 senses the sub-patterns which are transferred on the intermediate transfer belt 145 for each of the photosensitive media 141, 142, 143, and 144, and checks a gap variation of the sub-patterns, which can represent a periodic velocity variation of the photosensitive media 141, 142, 143, and 144.

In addition, the motor controller 200 may synchronize phases of each of the photosensitive media according to the checked gap variation, control the K motor 151 to drive the K photosensitive medium 141 at a constant velocity, and control the velocities of the C motor 152, the M motor 153, and the Y motor 154 and the intermediate transfer belt motor 155 so that the other photosensitive media 142, 143, and 144 and the intermediate transfer belt 145 follow the linear velocity of the K photosensitive medium 141. In this case, the intermediate transfer belt 145 is driven independently from the K motor 151, and thus, the velocity of the intermediate transfer belt 145 is controlled by the linear velocity of the K photosensitive medium 141.

As described above, the image forming apparatus 100 according to the exemplary embodiment may drive five objects to be driven by using five motors so that the linear velocities of the objects are not changed. In addition, the image forming apparatus illustrated in FIGS. 6 and 7 according to the exemplary embodiment may include fewer motors than the image forming apparatus illustrated in FIGS. 8 and 9 according to the exemplary embodiment, which may reduce the costs and increase the degree of the freedom in design.

Figure 10:
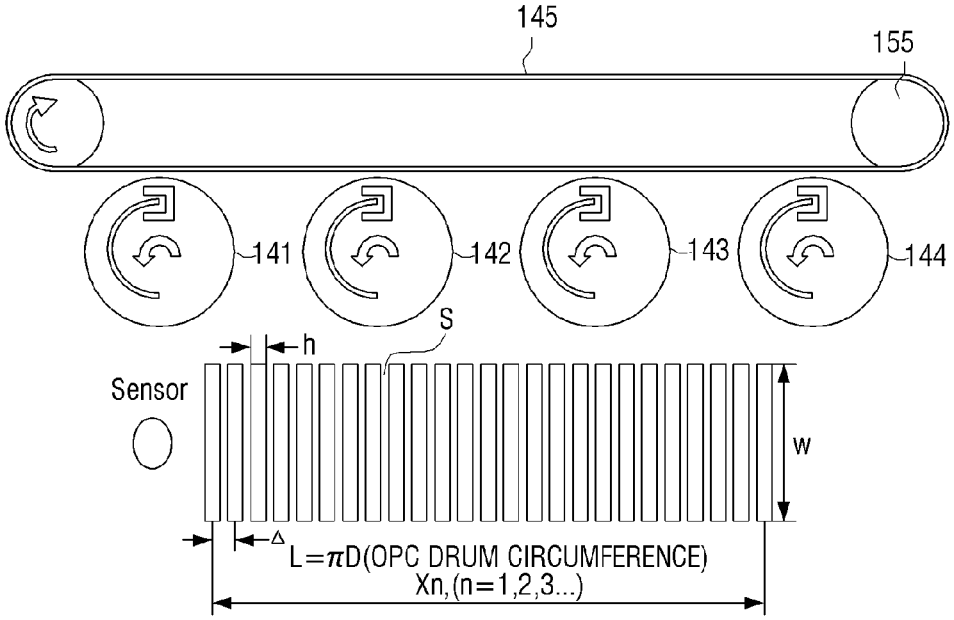
FIG. 10 is a diagram illustrating a pattern for sensing a position change due to a velocity variation of a photosensitive medium.
Figure 11:
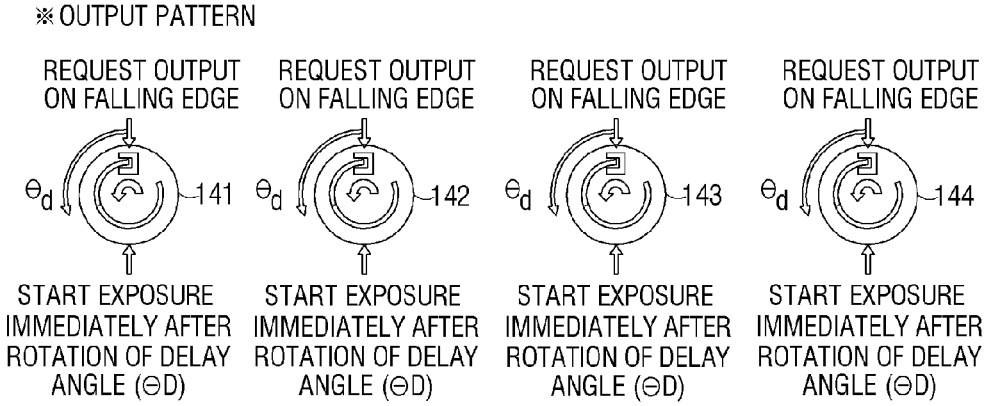
FIG. 11 is a diagram illustrating a method of outputting a pattern of a photosensitive medium.

FIG. 10 is a diagram illustrating a pattern P usable to sense a position change due to a velocity variation of a photosensitive medium, and FIG. 11 is a diagram illustrating a method of outputting the pattern P.

Referring to FIGS. 10 and 11, the pattern P which is transferred on the intermediate transfer belt 145 in order to determine a gap variation which occurs due to the velocity variation of a photosensitive medium may include sub-patterns, for example, a plurality of bar-shaped patterns P1 to P25. The bar-shaped patterns P1 to P25 are configured to have a same thickness h and a gap Δ of a same distance between centers of the adjacent sub-patterns or a space S between the adjacent sub-patterns.

The pattern P may have a length L corresponding to an integer ratio of a circumference length of a photosensitive medium, which is effective in stable data acquisition and increase of an error fitting accuracy. The sub-patterns are repeatedly outputted by the number of times of a, in an order of Y, M, C, and K.

The engine 140 forms a black pattern K, a magenta pattern M, a cyan pattern C, and a yellow pattern Y on each of the photosensitive media 141, 142, 143, and 144, and transfers the formed sub-patterns on the intermediate transfer belt 145.

In addition, the engine 140 transfers the pattern P on the intermediate transfer belt 145 one or more times with respect to each of the photosensitive media 141, 142, 143, and 144, which is to detect data more accurately and remove an unexpected measurement value. When the engine 140 transfers the pattern P one or more times, the engine 140 forms the sub-patterns on the respective photosensitive media 141, 142, 143, and 144 at the same time based on the home position of the photosensitive media 141, 142, 143, and 144.

As described below, the controller 160 determines a gap variation function by fitting a gap variation due to a periodic linear velocity variation of the photosensitive media 141, 142, 143, and 144 as a sine function, for example, obtains a velocity function of each motor by using the gap variation function, and allows the other motors 152, 153, and 154 to estimate a velocity of the one motor 151. The above described operation of the controller 160 may restrict (reduce) the velocity variation of the photosensitive media 141, 142, 143, and 144, thereby significantly reducing the color dislocation.

Hereinafter, for convenience in description, operations of determining a gap variation of a pattern to detect a color dislocation, obtaining a motor velocity variation which reduces a velocity variation of a photosensitive medium based on the gap variation, and varying a velocity of a motor according to the obtained motor velocity variation will be described by taking a photosensitive medium as an example.

Figure 12:
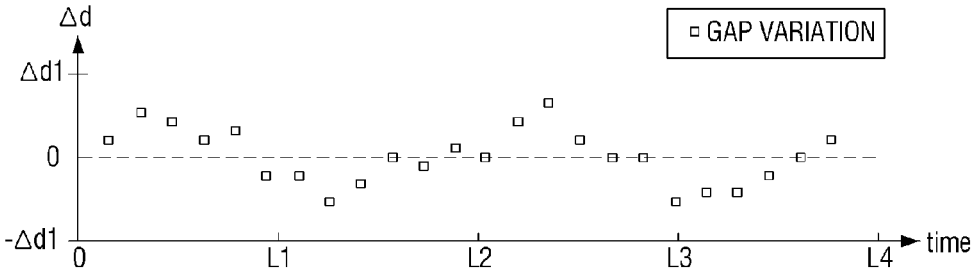
FIG. 12 is a graph illustrating a distance between sub-patterns of the pattern of FIG. 10.
Figure 13:
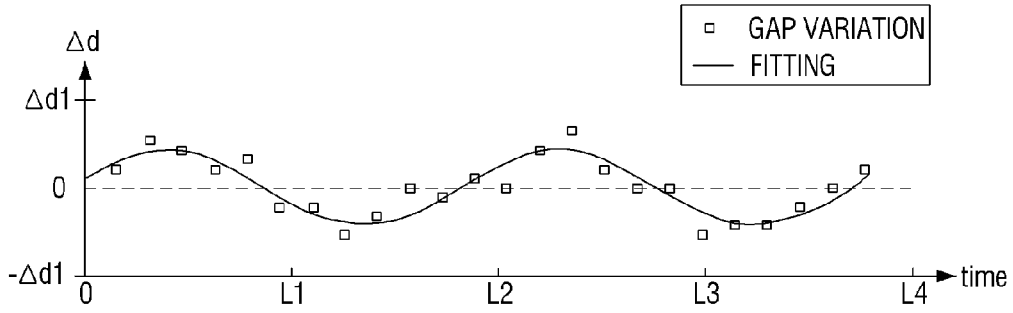
FIG. 13 is a graph illustrating a method of fitting a distance between sub-patterns of FIG. 12.

FIG. 12 is a graph illustrating a distance between sub-patterns of FIG. 10 and FIG. 13 is a graph illustrating an operation of fitting the distance between sub-patterns of FIG. 12.

As illustrated in FIG. 12, a gap difference Δd is obtained by subtracting an original pattern distance (or a reference pattern distance) from a sensed pattern distance.

The gap difference Δd is a distance between the bar-shaped patterns and is fitted by using a sine function of $A \sin(\psi x/Vo+\theta)$. An optimal fitting may be obtained by finding A and θ which make a sum of squared errors where the gap difference Δd and a difference of $A \sin(\psi x/Vo+\theta)$ respectively calculated based on each sensed data are raised to second power be minimized from each of given ranges of $0 \le A \le [(\mathrm{Max}(\Delta d)-\mathrm{Min}(\Delta d))/2]$ and $0 \le \theta \le 2\pi$, as illustrated in FIG. 13.

In the above fitting process, four of θ are obtained. In this case, only when a difference between a maximum value and minimum value is below 90 degrees, an average value of the four θ is calculated, two maximum values are selected from among four of A, and an average value of the two maximum values is calculated. A value at this point is recognized as an amount and phase of a final gap variation function.

When the gap variation is obtained, it is required to determine a relationship between the gap variation and the motor velocity in order to reduce the gap variation. As illustrated in FIG. 13, the gap variation which is obtained from the pattern P to detect a color dislocation represents a periodic variation form, and thus, may be expressed as a sine function of $A \sin(\psi t+\theta)$.

As given above, the operation of recognizing a gap difference from the formed pattern P and calculating a velocity according to the gap difference has been described. Hereinafter, a method of controlling each motor according to the calculated velocity will be described in detail with reference to FIGS. 14 and 15.

Figure 14:
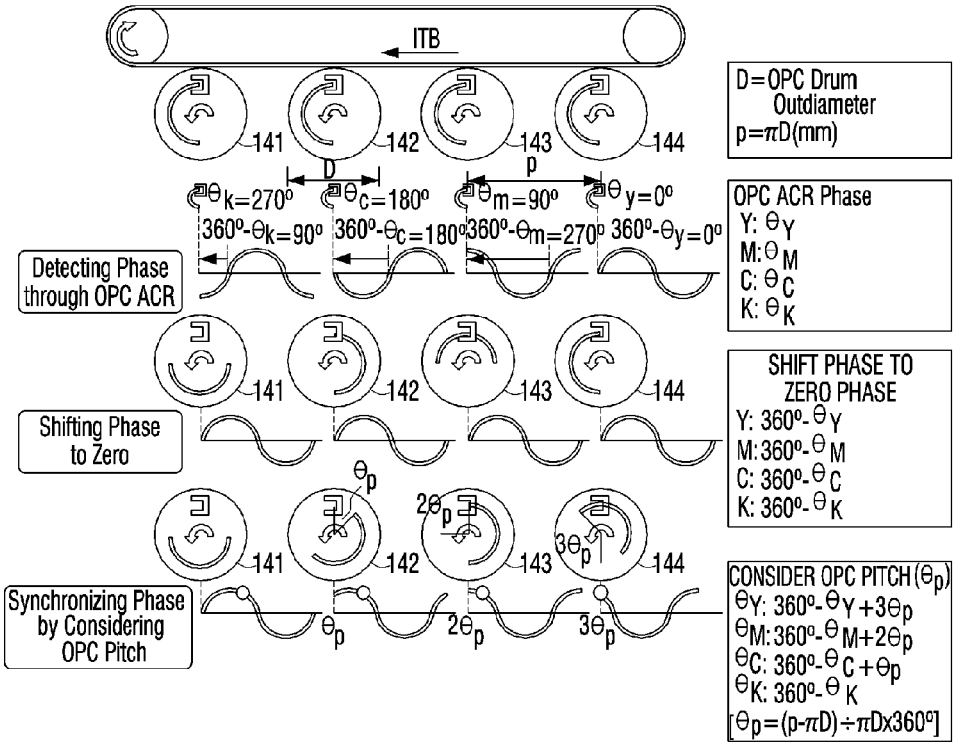
FIG. 14 is a diagram illustrating a method of controlling a phase synchronization of a photosensitive medium.

FIG. 14 is a diagram illustrating a method of controlling a phase synchronization of a photosensitive medium.

Referring to FIG. 14, as described in connection with FIGS. 10 and 11, a pattern is outputted based on a home position of a photosensitive medium. In this case, the photosensitive media 141, 142, 143, and 144 are driven at a constant velocity without controlling a motor. The photosensitive media may be an organic photoconductor (OPC)

After the above-described auto color registration (ACR) operation is performed with respect to the photosensitive medium, phases of the respective photosensitive media 141, 142, 143, and 144 are detected. In addition, the photosensitive medium where the ACR operation is finished is rotated by the following angle and stopped based on the home position.

$$\equiv_Y = 360° - \theta_Y + 3\theta_p$$

$$\equiv_M = 360° - \theta_M + 2\theta_p$$

$$\equiv_C = 360° - \theta_C + \theta_p$$

$$\equiv_K = 360° - \theta_K \qquad \text{[Formula 4]}$$

In $\theta_p = (p-\pi D)/\pi D * 360°$, p refers to a pitch of a photosensitive medium.

Meanwhile, when an operating time of the photosensitive medium is sequentially arranged in the order of Y, M, C, and K, each photosensitive medium is rotated by the following angle and stopped based on the home position, considering the sequential operating time.

$$\equiv_Y = 360° - \theta_Y + 3\theta_p - 3\theta_t$$

$$\equiv_M = 360° - \theta_M + 2\theta_p - 2\theta_t$$

$$\equiv_C = 360° - \theta_C + \theta_p - \theta_t$$

$$\equiv_K = 360° - \theta_K \quad \text{[Formula 5]}$$

In this cases, $\theta_t = t_\Delta/(\pi D/Vo)*360°$, Vo refers to a processing velocity, and $Vo = \pi D \times f$, f refers to a rotational frequency of a photosensitive medium.

As described above with reference to FIG. 14, the phases of the photosensitive media are detected through the ACR operation on the OPC, and then the phases of the photosensitive media may be shifted to zero, for example, a common phase or a same phase. The phases of the photosensitive media may be synchronized by considering a pitch of each photosensitive medium.

Figure 15:
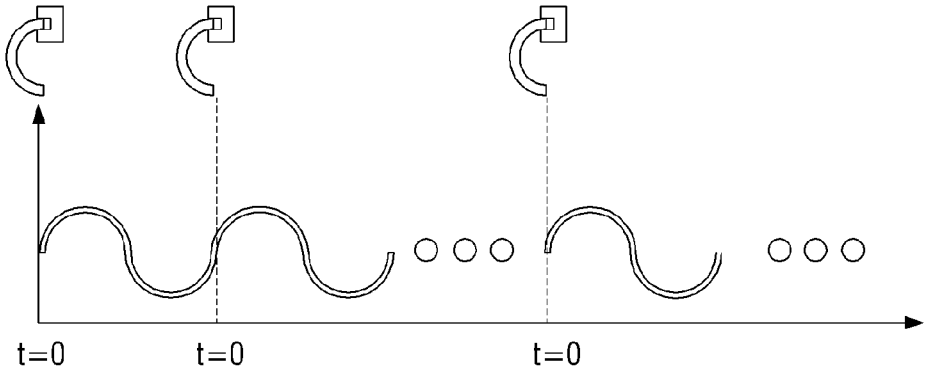
FIG. 15 is a diagram illustrating a feed-forward control with respect to a velocity of a photosensitive medium.

FIG. 15 is a diagram illustrating a feed-forward control with respect to a velocity of a photosensitive medium.

Referring to FIG. 15, in order to minimize a color registration error which can occur due to a difference of a velocity variation of the photosensitive medium for each color, the feed-forward control is performed with respect to the velocity variation of the photosensitive medium for each color, which is recognized as the above described auto color registration (ACR) pattern of the photosensitive medium.

An amount and phase of an AC element in the photosensitive medium are detected based on a result of the velocity variation of each photosensitive medium.

Each motor is driven by the following Formula 6 based on the detected AC element and phase.

$$\text{Motor input} = V_{MT} + A_{MT} T \sin(\psi t + \theta_{MT}) \quad \text{[Formula 6]}$$

Herein, $V_{MT}$ refers to a reference velocity of a motor, $A_{MT}$ refers to an amount of motor control input (Hz) That is $A_{MT} = \psi(A - Ak)V_M/Vo$, A refers to AC elements ($A_Y$, $A_M$, $A_C$, $A_K$) which are measured with respect to the photosensitive medium, $\theta_{MT}$ refers to a phase of motor control input (rad) that is $\theta_{MT} = (\theta + \theta d) \times \pi/180°$, θ refers to phases ($\theta_Y$, $\theta_M$, $\theta_C$, $\theta_K$) which are measured with respect to the photosensitive medium (deg), θd refers to a time delay phase, ψ refers to an acceleration (rad/s) that is $\psi = 2\pi f = 2\pi * V_D/\pi D$ and $Vo = D \times f$, D refers to a diameter of the photosensitive medium, and f refers to a rotational frequency (Hz).

A control cycle of a motor corresponds to a period of a single rotation of the photosensitive medium. That is, a time t is reset as zero '0' based on Rib every time the photosensitive medium rotates once since an accumulated error may occur after a few times of rotation is performed when the time t is not reset.

Figure 16:
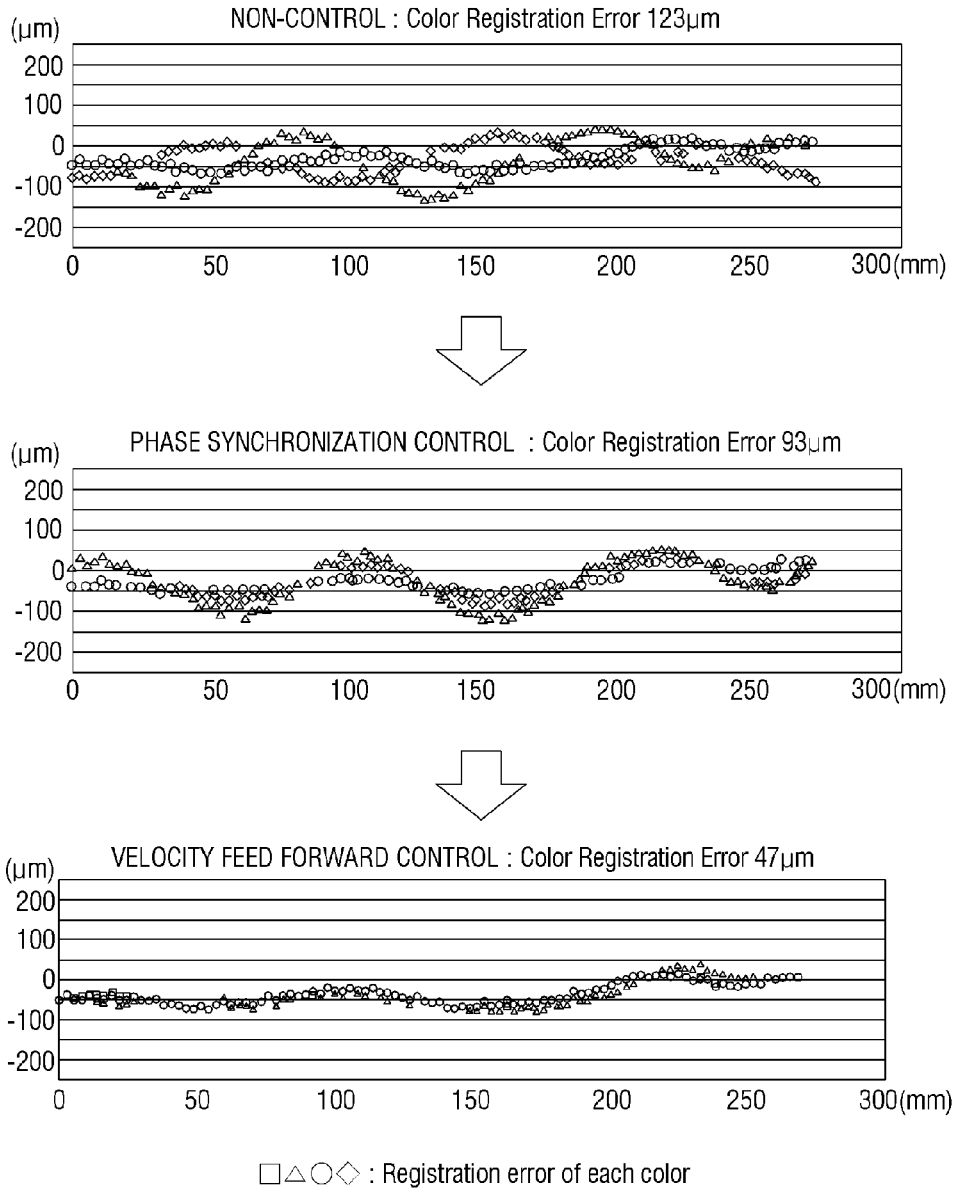
FIG. 16 is a diagram illustrating an experiment example of a method of controlling a velocity according to an exemplary embodiment of the present general inventive concept.

FIG. 16 is a diagram illustrating an experiment example of a method of controlling a velocity according to an exemplary embodiment of the present general inventive concept. An upper graph of FIG. 16 illustrates a registration error of each color when the velocity control is not performed, a middle graph of FIG. 16 illustrates a registration error of each color when only a phase synchronization control is performed, and a lower graph of FIG. 16 illustrates a registration error of each color when the velocity control according to an exemplary embodiment is performed.

FIG. 16 illustrates that a case when the control is performed has an improvement of approximately three times, that is, 76 μm as compared with a case when the control is not performed (Difference of registration errors is 123 μm).

Figure 17:
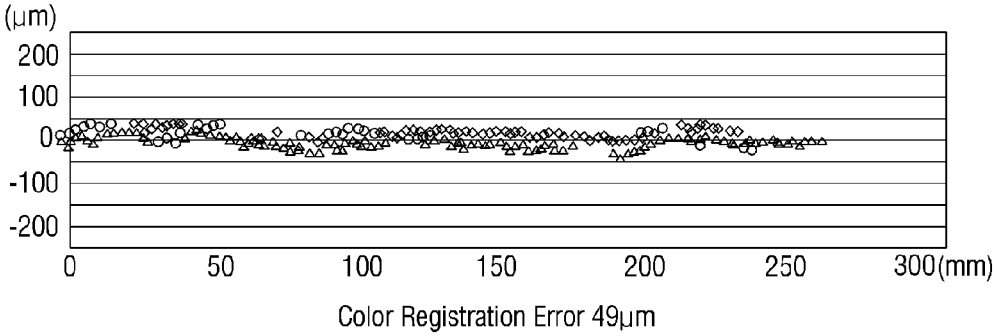
FIG. 17 is a diagram illustrating a registration error according to a controlling method of controlling a registration error.
Figure 18:
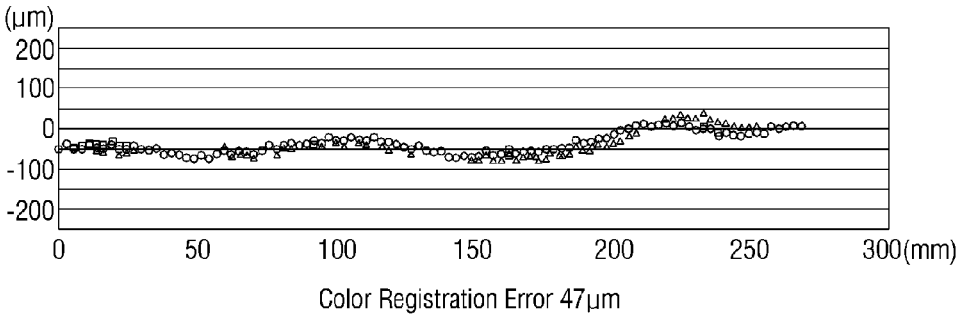
FIG. 18 is a diagram illustrating a registration error according to an exemplary embodiment of the present general inventive concept.

FIG. 17 is a diagram illustrating a registration error according to a conventional controlling method, and FIG. 18 is a diagram illustrating a registration error according to an exemplary embodiment of the present general inventive concept.

FIGS. 17 and 18 illustrate that the method of controlling a motor according to the present exemplary embodiment generates fewer registration errors between colors than the conventional method.

Figure 19:
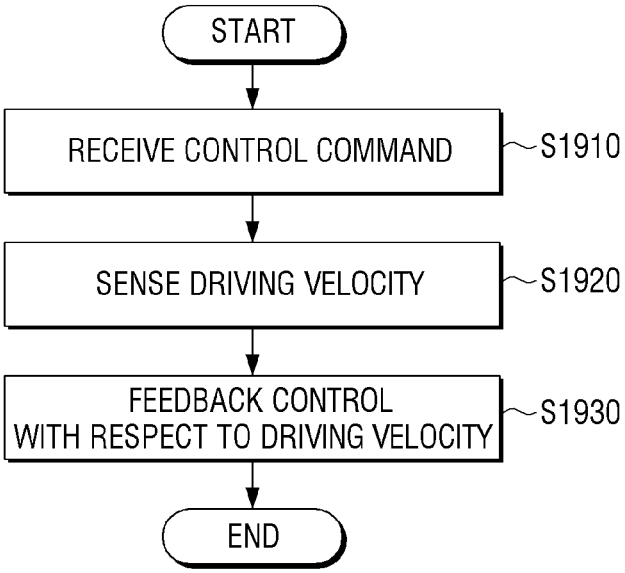
FIG. 19 is a flowchart illustrating a method of controlling a motor according to an exemplary embodiment of the present general inventive concept.

FIG. 19 is a flowchart illustrating a method of controlling a motor according to an exemplary embodiment of the present general inventive concept.

A control command with respect to a plurality of photosensitive media is received at operation S1910. In this case, the control command may include a control command to perform functions corresponding to rotation start/stop, acceleration/reduction of velocity, a velocity reference value with reference to the plurality of motors, etc.

A periodic velocity of each of the plurality of motors which drives each of the plurality of photosensitive media is received at operation S1920. A pattern formed on an intermediate transfer belt is sensed, a gap variation of each of the plurality of photosensitive media is sensed, and thus, a velocity in a form of a sine function corresponding to the checked gap variation may be calculated.

The plurality of motors are driven according to the sensed velocity at operation S1930. One of the plurality of motors is driven at a constant velocity, and the other motors are driven based on a periodic velocity of the one motor which is driven at a constant velocity by feedback-controlling the phases and velocities of the other motors. That is, the plurality of motors may be driven so that the C photosensitive medium, the M photosensitive medium, and the Y photosensitive medium follow the phase and linear velocity of the K photosensitive medium.

As described above, the method of controlling a motor according to the present exemplary embodiment may reduce a linear velocity variation of the motors by allowing the other motors to follow a velocity of a predetermined one motor rather than allowing all of the plurality of motors to follow an ideal velocity, which may reduce the color registration error. In addition, the method may not require an operation of controlling each motor, thereby improving the degree of freedom in design. The method of controlling a motor as illustrated in FIG. 19 may be executed on the image forming apparatus 100 having the configuration of FIG. 1 or the motor controller having the configuration of FIG. 2, and may be executed on an image forming apparatus or motor controller having other configuration.

As described above, a velocity is applied to one of the plurality of motors to drive one of photosensitive media and a periodic velocity of the one of the plurality of motors can be applied or used to control the other ones of the plurality of motors to drive the other ones of the photosensitive media. The periodic velocity may be a velocity generated or detected from the one motor. The periodic velocity may be a velocity output from the one motor which is used to synchronize phases of the motors. The periodic velocity may be a velocity corresponding to a periodic form, for example, a sine wave form.

Referring to FIG. 1, when the other ones of the plurality of motors 150 are controlled according to the periodic velocity, the motor controller 200 generates a velocity to be applied to the one motor of the plurality of motors 150 and also generates a periodic velocity to be applied to the other motors of the plurality of motors 150. In this case, the motor controller 200 may control the one motor with the velocity and the other motors with the periodic velocity. It is possible that when the one motor of the plurality of motors 150 receives a velocity from the motor controller 200, the one motor may generate the periodic velocity to be applied to the other motors. In this case, the periodic velocity may be directly output from the one motor to the other motors.

The motor controller 200 may store information or data on the velocity to be applied to the one motor and/or the periodic velocity to be applied to all of the other motors in a memory thereof. The memory may be included in the motor controller 200, in the controller 160, in at least one of the motors 150, or in the storage 130 according to a user or design preference.

As described above, one of motors can be usable to control the other ones of the motors in an image forming apparatus. However, the present general inventive concept is not limited thereto. It is possible that two of the motors can be controlled according to a corresponding velocity and/or phase and then one of the two motors can be useable to control the other ones of the motors. In this case, the one of the two motors may be a motor to drive one of the photosensitive media or an intermediate transfer belt. It is also possible that only one motor is controlled according to at least one of remaining motors which are controlled according to a corresponding velocity and/or phase. In this case, the only one motor may be a motor to drive an intermediate transfer belt, one of the photosensitive media, or other components of the image forming apparatus.

In addition, the aforementioned method may be embodied as a program (or application) including an algorithm which is executable on a computer, and the program may be stored and provided in a non-transitory computer readable medium.

The non-transitory recordable medium refers to a medium which may store data semi-permanently rather than storing data for a short time such as a register, a cache, and a memory and may be readable by an apparatus. Specifically, the above-described various applications and programs may be stored in the non-transitory recordable medium like a compact disc (CD), a digital versatile disk (DVD), a hard disk, a Blu-ray disk, a universal serial bus (USB), a memory card, and a read-only memory (ROM), etc., and provided therein.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus comprising:

an image forming unit configured to perform a printing operation by using a plurality of photosensitive media;

a plurality of motors configured to drive the plurality of photosensitive media; and a motor controller configured to drive the one motor from among the plurality of motors at a constant velocity and to feed-forward control a phase and a velocity of the other motor based on a periodic velocity of the one motor that is driven at the constant velocity and is not feed-forward controlled.

2. The apparatus of claim 1, wherein:

the plurality of photosensitive media are a K photosensitive medium, a C photosensitive medium, an M photosensitive medium, and a Y photosensitive medium;

the plurality of motors are a K motor which drives the K photosensitive medium, a C motor which drives the C photosensitive medium, an M motor which drives the M photosensitive medium, and a Y motor which drives the Y photosensitive medium; and the motor controller controls a velocity of the C motor, the M motor, and the Y motor based on a velocity of the K motor.

3. The apparatus of claim 2, wherein the K motor drives an image forming medium together with the K photosensitive medium.

4. The apparatus of claim 1, wherein the motor controller senses periodic velocities of the plurality of motors, synchronizes a velocity phase of each of the plurality of motors based on the sensed periodic velocities, and feed-forward controls the other motors to have a same velocity based on the periodic velocity of the one motor from among the plurality of motors whose velocity phases are synchronized.

5. The apparatus of claim 4, wherein the motor controller senses a home position of each of the plurality of photosensitive media, and determines a stop position of each of the plurality of photosensitive media based on the sensed periodic velocities and a home position thereof.

6. The apparatus of claim 4, wherein:

the image forming unit forms a preset pattern on the image forming medium by using each of the plurality of photosensitive media; and the motor controller senses a periodic velocity of each of the plurality of photosensitive media by sensing the pattern formed on the image forming medium.

7. The apparatus of claim 6, wherein the motor controller checks a gap variation of each of the plurality of photosensitive media by sensing the pattern formed on the image forming medium, and calculates the periodic velocity in a form of a sine function corresponding to the gap variation.

8. The apparatus of claim 7, wherein the motor controller controls the other motors to follow a sine function of the one motor.

9. The apparatus of claim 1, wherein the motor controller controls a velocity of the other motors to correspond to a period of a single rotation of a photosensitive medium.

10. A method of controlling a plurality of motors in an image forming apparatus, the method comprising:

receiving a control command with respect to a plurality of photosensitive media;

sensing a periodic velocity of each of a plurality of motors which drives each of the plurality of photosensitive media;

driving one motor at a constant velocity from among the plurality of motors; and feed-forward controlling and driving a phase and a velocity of the other motors based on the periodic velocity of the one motor which is driven at a constant velocity and is not feed-forward controlled.

11. The method of claim 10, wherein:

the plurality of photosensitive media are a K photosensitive medium, a C photosensitive medium, an M photosensitive medium, and a Y photosensitive medium;

the plurality of motors are a K motor which drives the K photosensitive medium, a C motor which drives the C photosensitive medium, an M motor which drives the M photosensitive medium, and a Y motor which drives the Y photosensitive medium; and the feed-forward controlling and driving comprises controlling a velocity of the C motor, the M motor, and the Y motor based on the velocity of the K motor.

12. The method of claim 11, wherein the K motor drives an image forming medium together with the K photosensitive medium.

13. The method of claim 10, further comprising:

synchronizing a velocity phase of each of the plurality of motors based on the sensed periodic velocity;

wherein the feed-forward controlling and driving comprises feed-forward controlling the other motors to have a same velocity based the periodic velocity of the one motor from among the plurality of motors whose velocity phases are synchronized.

14. The method of claim 13, wherein the synchronizing comprises determining a stop position of each of the plurality of photosensitive media according to the sensed periodic velocity and the home position.

15. The method of claim 13, wherein the sensing the periodic velocity comprises forming a preset pattern on an image forming medium by using each of the plurality of photosensitive media, and sensing a periodic velocity of each of the plurality of photosensitive media by sensing the pattern formed on the image forming medium.

16. The method of claim 15, wherein the sensing the periodic velocity comprises checking a gap variation of each of the plurality of photosensitive media by sensing the pattern formed on the image forming medium, and calculating a velocity in a form of a sine function corresponding to the gap variation.

17. The method of claim 16, wherein the feed-forward controlling and driving comprises controlling the other motors to follow a sine function of the one motor.

18. The method of claim 10, wherein the feed-forward controlling and driving comprises controlling a velocity of the other motors to correspond to a period of a single rotation of a photosensitive medium.

19. A non-transitory computer readable medium having computer-readable codes as a program to execute a method claim 10.

* * * * *